US010406071B2

(12) United States Patent
Davidson

(10) Patent No.: US 10,406,071 B2
(45) Date of Patent: Sep. 10, 2019

(54) NEEDLE-LESS VIAL ASSEMBLY FOR USE WITH NEEDLE-FREE SYSTEM

(71) Applicant: Stephanie Davidson, Las Vegas, NV (US)

(72) Inventor: Stephanie Davidson, Las Vegas, NV (US)

( * ) Notice: Subject to any disclaimer, the term of this patent is extended or adjusted under 35 U.S.C. 154(b) by 154 days.

(21) Appl. No.: 15/623,144

(22) Filed: Jun. 14, 2017

(65) Prior Publication Data

US 2017/0281468 A1 Oct. 5, 2017

Related U.S. Application Data

(63) Continuation of application No. 14/867,654, filed on Sep. 28, 2015, now abandoned, which is a continuation of application No. 14/590,689, filed on Jan. 6, 2015, now Pat. No. 9,173,815, which is a continuation of application No. 14/509,767, filed on Oct. 8, 2014, now abandoned.

(60) Provisional application No. 61/888,360, filed on Oct. 8, 2013.

(51) Int. Cl.
*A61J 1/20* (2006.01)

(52) U.S. Cl.
CPC ..... *A61J 1/2096* (2013.01); *A61J 1/201* (2015.05); *A61J 1/2037* (2015.05); *A61J 1/2051* (2015.05)

(58) Field of Classification Search
CPC ..... A61J 1/00; A61J 1/20; A61J 1/201; A61J 1/2006; A61J 1/2089; A61J 1/2096
USPC ..... 141/319, 329; 604/411, 414–416
See application file for complete search history.

(56) References Cited

U.S. PATENT DOCUMENTS 3,206,073 A * 9/1965 Scislowicz ..... A61J 1/2089 141/329
5,520,666 A * 5/1996 Choudhury ..... A61M 39/045 604/537
5,527,306 A * 6/1996 Haining ..... A61J 1/2096 604/411
5,620,434 A * 4/1997 Brony ..... A61J 1/2096 141/320
6,089,541 A * 7/2000 Weinheimer ..... A61M 39/26 251/149.1
9,173,815 B2 * 11/2015 Davidson ..... A61J 1/2096

* cited by examiner

*Primary Examiner* — Timothy L Maust
(74) *Attorney, Agent, or Firm* — David G. Henry, Sr.

(57) ABSTRACT

A needle-less vial assembly that includes a substance transfer assembly configured to telescopically engage with a vial neck of a vial. A first portion of the substance transfer assembly is configured to sealingly engage with an interior wall of the vial neck, where the first portion includes a first inlet configured to receive a substance from the vial. A second portion of the substance transfer assembly is configured to matingly engage with a syringe, and includes an outlet configured to dispense the substance to the syringe. A channel is defined through the first portion and the second portion, thereby enabling fluid communication of the substance from the vial to the syringe via the first inlet and the outlet.

18 Claims, 4 Drawing Sheets

NEEDLE-LESS VIAL ASSEMBLY FOR USE WITH NEEDLE-FREE SYSTEM

STATEMENT OF PRIORITY

The present application is a continuation of, and claims priority to U.S. Nonprovisional application Ser. No. 14/867,654, titled "Needle-Less Vial Assembly for Use with Needle-Free System" and filed on Sep. 28, 2015, which is a continuation of U.S. Pat. No. 9,173,815, titled "Needle-Less Vial Assembly for Use with Needle-Free System," and issued on Nov. 3, 2015, and which is a continuation of U.S. Nonprovisional application Ser. No. 14/509,767, titled "Needle-Less Vial Assembly for Use with Needle-Free System," and filed on Oct. 8, 2014, which claims the benefit of U.S. Provisional Application No. 61/888,360, titled "Vial Assembly For Use With Needle-Free System," and filed Oct. 8, 2013.

TECHNICAL FIELD

The present disclosure relates to a medical needle-less vial assembly having a medical needle-free connector for use with medical vials and syringes.

BACKGROUND

Pharmaceutical chemicals in the form of liquids and powders may be stored for use in vials. Vials are typically sealed by a rubber stopper, a metal foil positioned over the stopper and over the vial's flange, as well as a port to access the vial. Vials come in a variety of opening sizes such as 5 cc, 10 cc, and 20 cc among others.

The common method of extracting medicine from a vial is to advance a needle or pointed device into a stopper and draw product from the vial. This procedure has its downside. The use of a traditional syringe with a needle creates the potential for accidental injuries, and contamination of the healthcare worker with blood borne transmittable diseases or with dangerous pharmaceutical such as alkylating agents or antimetabolites particularly utilized in the field of oncology where many fluids may be harmful if touched or inhaled. Other methods involve the use of various needle-free vial adapters that may still include an unprotected sharp piercing member that exposes the health care professional to the same type of dangers while she tries to insert the adapter into the vial.

In an effort to combat the needle stick hazard, various types of adapters have been introduced in the market. They all appear to possess shortcomings which hinder widespread acceptance by medical practitioners. For example, adapters are supplied as separate components and they are configured to be manually inserted within a vial by a skilled health care practitioner who is required to pierce the vial by forcing the sharp piercing member of an adapter against the rubber stopper of the vial. In some situations, it may be difficult for an adapter to efficiently penetrate a stopper due to variations in depth or thickness of its rubber. Additionally, the force with which the sharp piercing member is advanced to a stopper may cause the stopper to become trapped within the passage in the neck of a vial.

It is also undesirable to use an adapter that does not have the capability of extracting the entire pharmaceutical for various reasons. Using an adapter that needs insertion into a vial may create an insecure assembly that allows fluid to leak between vial and the adapter. In addition, many adapters do not provide a sealed connection with a syringe; thus, wasting expensive product in the process of extraction.

Manufacturers of medical adapters consider keeping costs as low as possible without compromising the safety and effectiveness of the device. Most adapters are composed of numerous parts that must be sealed together to form a complete kit. This process may be unnecessarily cumbersome. Furthermore, hospitals and clinics are mindful of the expense involved in purchasing numerous types and sizes of adapters to fit the various vial closures. To overcome many of these deficiencies, there has been recognized the need for a device which comprises a unified part and is capable of high speed manufacturing while minimizing the opportunity of malfunction.

Further, a need has been recognized for a leakage-free device capable of forming a continuously closed system, the system effectively sealing the fluid passageway from the environment during the insertion of a needle-free device.

SUMMARY OF THE INVENTION

The present disclosure introduces various illustrative embodiments for a needle-less vial assembly arranged at least partially within a vial and which includes a needle-less means for matingly engaging with a syringe.

It is an object of the present disclosure to provide a substance transfer assembly configured to telescopically engage with a vial neck of a vial. A first portion of the substance transfer assembly includes means for sealingly engaging with an interior wall of the vial neck, the first portion having a first inlet configured to receive a substance from the vial. A second portion of the substance transfer assembly includes means for matingly engaging with a syringe and an outlet configured to dispense the substance to the syringe. A channel is defined through the first portion and the second portion, thereby enabling fluid communication of the substance from the vial to the syringe via the first inlet and the outlet.

Another object of the present disclosure includes a method for removing a substance from a vial, the method including sealingly engaging a substance transfer assembly with an interior wall of a vial neck of a vial, wherein the substance transfer assembly includes a first portion having a first inlet configured to receive a substance from the vial, a second portion having means for matingly engaging with a syringe and an outlet configured to dispense the substance to the syringe, and a channel defined through the first portion and the second portion, thereby enabling fluid communication of the substance from the vial to the syringe via the first inlet and the outlet. The method further includes matingly engaging the syringe to the second portion of the substance transfer assembly, and removing the substance from the vial to the syringe via movement of a plunger of the syringe in a first direction, thereby drawing the substance from the vial into the syringe via the first inlet and the outlet.

BRIEF DESCRIPTION OF THE DRAWINGS

The following figures are included to illustrate certain aspects of the present invention, and should not be viewed as an exclusive embodiments. The subject matter disclosed is capable of considerable modification, alteration, and equivalents in form and function, as will occur to one having ordinary skill in the art and the benefit of this disclosure.

DETAILED DESCRIPTION

Figure 1:
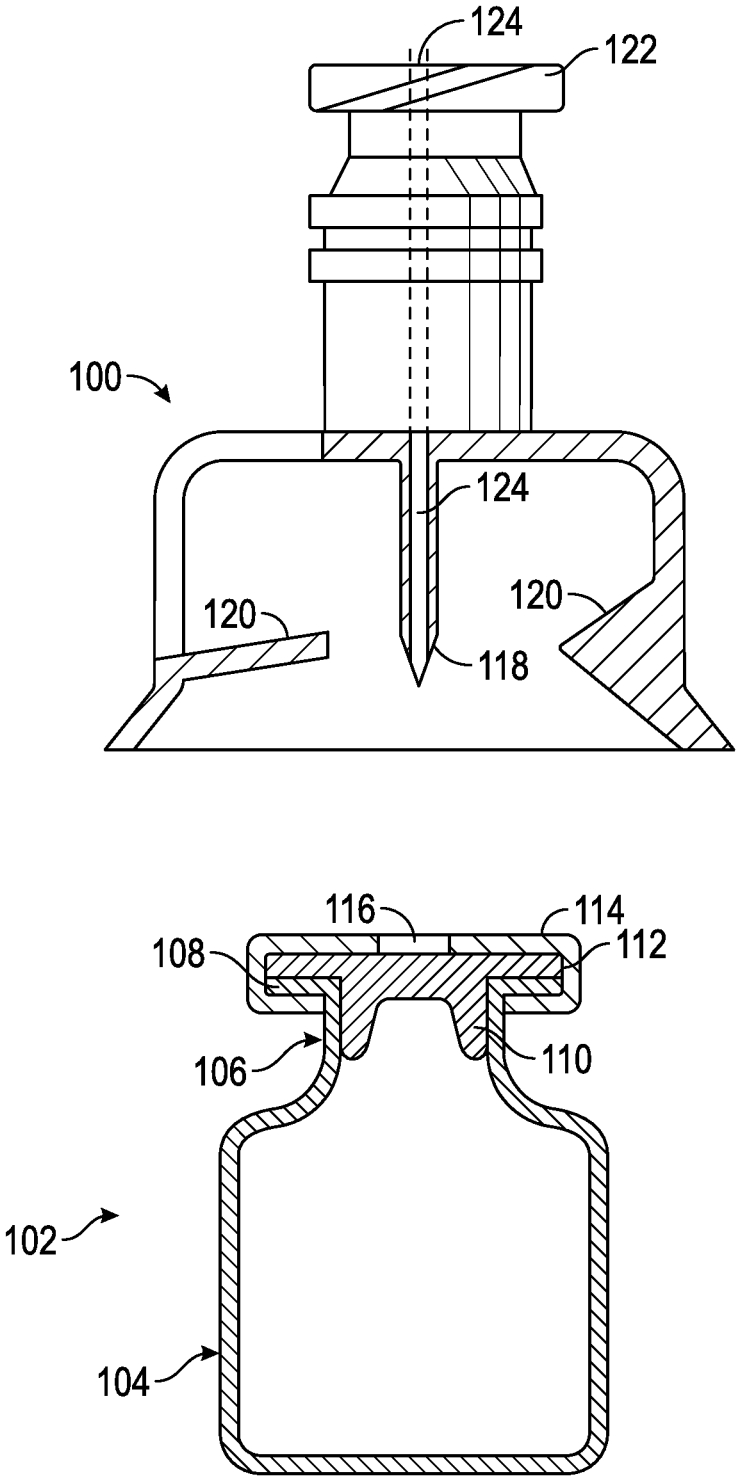
FIG. 1 (Prior Art)
FIG. 1 is a cross-sectional illustration of a prior art adapter that employs a piercing member to access a substance inside a vial.

The present disclosure relates to systems and methods of a medical needle-less vial assembly having medical needle-free connectors for use with medical vials and syringes.

An illustrative system includes a substance transfer assembly configured to telescopically engage with a vial neck of a vial. A first portion of the substance transfer assembly includes means for sealingly engaging with an interior wall of the vial neck, the first portion having a first inlet configured to receive a substance from the vial. A second portion of the substance transfer assembly includes means for matingly engaging with a syringe and an outlet configured to dispense the substance to the syringe. A channel is defined through the first portion and the second portion, thereby enabling fluid communication of the substance from the vial to the syringe via the first inlet and the outlet.

An illustrative method for removing a substance from a vial includes sealingly engaging a substance transfer assembly with an interior wall of a vial neck of a vial, wherein the substance transfer assembly includes a first portion having a first inlet configured to receive a substance from the vial, a second portion having means for matingly engaging with a syringe and an outlet configured to dispense the substance to the syringe, and a channel defined through the first portion and the second portion, thereby enabling fluid communication of the substance from the vial to the syringe via the first inlet and the outlet. The method further includes matingly engaging the syringe to the second portion of the substance transfer assembly, and removing the substance from the vial to the syringe via movement of a plunger of the syringe in a first direction, thereby drawing the substance from the vial into the syringe via the first inlet and the outlet.

Referring now to the drawings, wherein like reference numbers are used herein to designate like elements throughout the various views and embodiments of a unit. The figures are not necessarily drawn to scale, and in some instances the drawings have been exaggerated and/or simplified in places for illustrative purposes only. One of the ordinary skill in the art will appreciate the many possible applications and variations based on the following examples of possible embodiments. As used herein, the "present disclosure" refers to any one of the embodiments described throughout this document and does not mean that all claimed embodiments must include the referenced aspects.

FIG. 1 depicts a cross-sectional view of a prior art adapter 100 employed to remove a substance from a vial 102. The vial 102 includes a body 104, a neck 106, and an annular lip 108. A sealing mechanism 110, such as a rubber stopper, is arranged within the neck 106, and includes a flange portion 112 above the neck 106 and adjacent to the top of the annular lip 108. The vial 102 further includes a cover 114 with an opening 116. The adapter 100 includes a piercing member 118, two arms 120, and an outlet 122 having a channel 124 therein, the channel 124 running through the piercing member 118.

In exemplary operation to remove a substance from the vial 102, the adaptor 100 is placed on the vial 102, wherein the piercing member 118 is arranged in a position to be correspondingly inserted through the opening 116 and pierce the sealing mechanism 110, thereby enabling the channel 124 within the piercing member 118 to access the substance within the vial 102. Further pressure may be applied to the adapter 100, forcing the arms 120 to each be driven past the annular lip 108, and thereby locking the adapter 100 onto the vial 102.

A syringe (not shown) may be coupled to the adaptor 100 via the outlet 122, thereby enabling withdrawal of the substance from the vial 102 via the channel 124. Notably, however, there are many significant drawbacks and risks with using the adaptor 102. For example, the adaptor 102 still requires an exposed piercing member 118 (i.e., a needle or other sharp pointed object) to pierce the flange 112 and enable access to the substance within the vial 102. Such a member could cause injury if mishandled or accidentally touched prior to being applied to the vial 102.

Further, additional force is required to lock the adaptor 100 onto the vial 102, such additional force also being transferred to the vial 102, possibly causing breakage of the vial 102 and exposure of the substance inside. Alternatively, the vial 102 may be expelled from the adaptor 100 prior to the arms 120 locking. Further, the arms 120 may break, thereby enabling release of the adaptor 100 from the vial 102 and exposing both the substance in the vial 102 and the piercing member 118. Moreover, once the adaptor 100 is locked on the vial 102, it is unremovable, thereby keeping a permanent open airway allowing contamination between the substance in the vial 102 and the open air.

Figure 2:
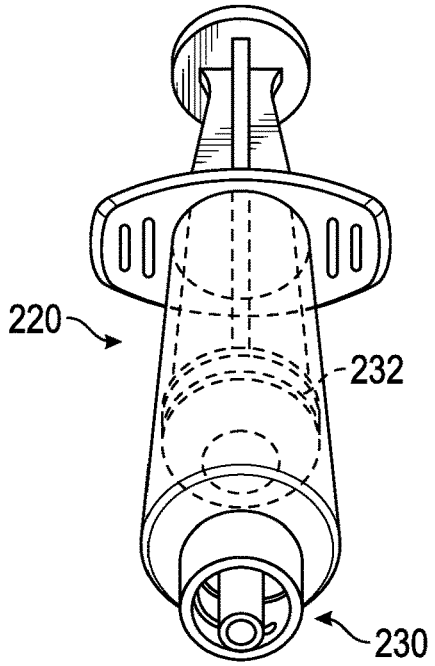
FIG. 2 depicts a needle-less vial assembly that enables removal of a substance from a vial, according to one or more embodiments.
Figure 2:
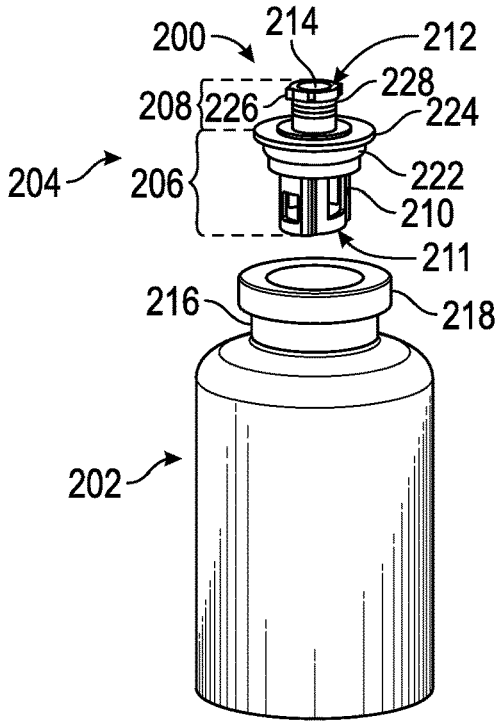

FIG. 2 depicts a needle-less vial assembly 200 that enables removal of a substance from a vial 202, according to one or more embodiments. As depicted, the vial assembly 200 includes an assembly body 204 comprising a first portion 206 and a second portion 208. The first portion 206 includes a first inlet 210 arranged longitudinally along the first portion 206 and proximate to the second portion 208. Advantageously, such an arrangement of the first inlet 210 being proximate to the second portion 208 enables substantially all of the substance to be withdrawn from the vial 202 which was previously problematic. In some embodiments, the substance may be, for example and without limitation, a pharmaceutical drug or combination of pharmaceutical drugs, as used by physicians in the treatment of patients.

In some embodiments, a plurality of first inlets 210 are included, thus enabling increased accuracy and speed of substance withdrawal from the vial 202. In further embodiments, a second inlet 211 may be arranged at the end of the first portion 206, thereby also increasing accuracy and speed of substance withdrawal from the vial 202. A hole or outlet 212 is arranged at the end of the second portion 208, with a channel 214 therein, thereby enabling fluid communication of a substance from the vial 202 to a syringe 220 coupled to the second portion 208 via the first inlet 210 and the channel 214.

As depicted in FIG. 2, the vial 202 further includes a neck 216 and an annular lip 218. In exemplary operation, the assembly body 204 is arranged at least partially within the neck 216 of the vial 202, thereby situating the first portion 206 within the vial 202. In some embodiments, the assembly 200 further includes a means 222 for sealingly engaging to the neck 216 of the vial 202. For example, such sealingly engaging means 222 may include a plastic or rubber gasket arranged about the exterior of the first portion 206.

In some embodiments, the assembly 200 may further include a shoulder 224. In exemplary operation, when the assembly 200 is within the vial 202, the shoulder may be placed adjacent to and in contact with the top of the annular lip 218, thereby preventing the assembly 200 from being further inserted into the vial 202. In further embodiments, the sealingly engaging means 222 may be arranged about the first portion 206 beneath the shoulder 224, thereby creating a sealed engagement between the shoulder 224 and annular lip 218.

In some embodiments, the assembly 200 includes a means for matingly engaging with the syringe 220. Such means may be, for example and without limitation, a luer-lock or luer-slip type engagement, possibly including tabs 226 and/or threads 228. The syringe may include a corresponding engagement mechanism 230, such as a male luer portion which correspondingly mates with the female luer (e.g. tabs 226 and/or threads 228) of the assembly 200.

In exemplary operation, the vial 202 contains a substance, such as a medicinal drug for surgery, and the assembly 200 is arranged within the vial 202 as previously described. The syringe 220 is matingly engaged to the second portion 208 of the assembly 200 via the tabs 226 and/or threads 228. The vial 202 and syringe 220 are tilted or positioned upside down such that the substance is conveyed towards the first portion 206 of the vial assembly 200. A plunger 232 of the syringe 220 is moved in a direction away from the vial 202, thereby conveying the substance within the vial 202 from the vial 202 to the syringe 220 via the first inlet 210, the channel 214, and the outlet 212.

One disadvantage of the prior art included failure to remove substantially all of the substance within the vial 102 (FIG. 1) due to the piercing member 118 extending a substantial length into the vial 102. Advantageously, this problem is substantially reduced and/or eliminated in the present disclosure due to having the first inlet 210 arranged proximate to the second portion 208 of the assembly 200, thereby enabling substantially all of the substance within the vial 202 to be withdrawn into the syringe 220. Additionally, unlike the prior art, which required a sharp piercing member 118, the present invention increases safety due to having no sharp piercing member, but instead being arranged at least partially within the neck 216 of the vial 202.

In some embodiments, the vial 202 may be one of a 1, 2, 5, 10, or 20 cc vial, as may typically be used by those skilled in the art and the medical industry. However, those skilled in the art will appreciate, and it is contemplated herein, that the vial assembly 202 may be utilized with vials of any size, larger or smaller as well without departing from the scope of the present disclosure. Moreover, the vial assembly 200 may be arranged at least partially within the neck 216 of the vial 202 by a manufacturer after the substance has been deposited within the vial. Such is advantageous due to then being readily usable, and not requiring assembly by, for example, doctors or nurses who will be withdrawing the substance in preparation for administration to a patient.

Figure 3:
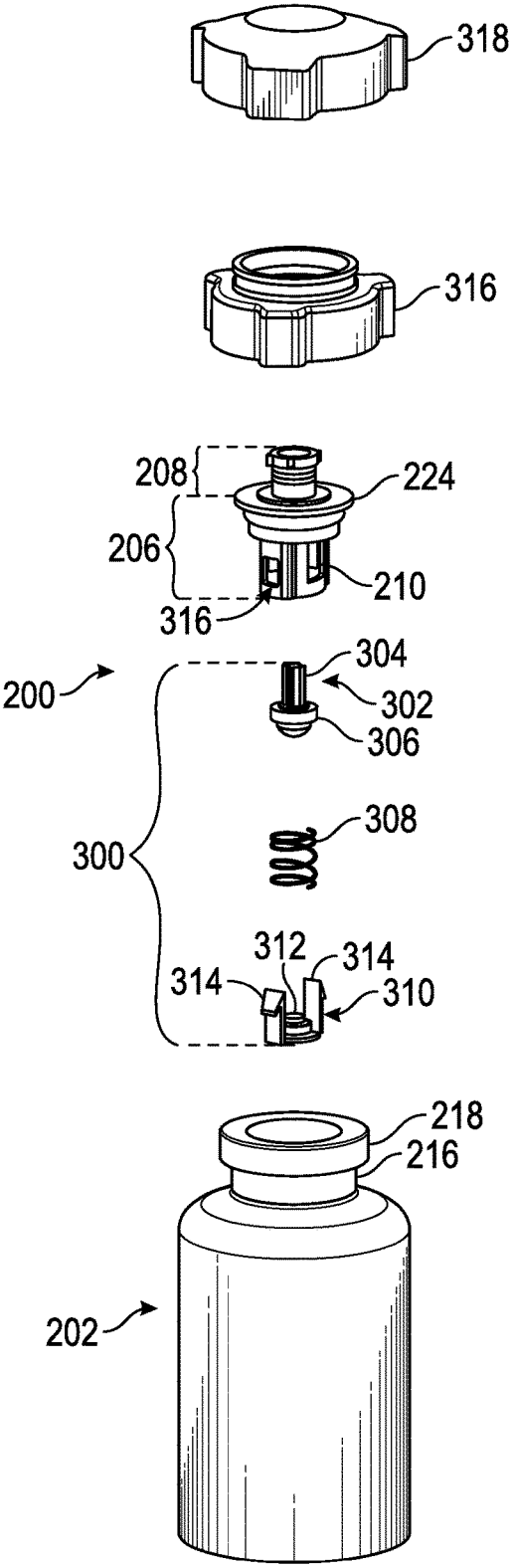
FIG. 3 depicts another embodiment of the needle-less vial assembly that enables removal of a substance from a vial.

FIG. 3 depicts another embodiment of the needle-less vial assembly 200 that enables removal of a substance from the vial 202. As depicted, similar to FIG. 2, the assembly 200 includes a body having a first portion 206 and a second portion 208, wherein the first portion 206 includes a first inlet 210. While not all embodiments are shown or labeled in FIG. 3 as depicted in FIG. 2, it will be appreciated by those skilled in the art that such embodiments are possible and hereby contemplated to also be included in FIG. 3 without departing from the scope of the invention.

Further embodiments depicted in FIG. 3 include a means 300 for enabling the substance within the vial 202 to be withdrawn only when the syringe 220 (FIG. 2) is matingly engaged to the second portion 208 of the assembly 200. Advantageously, such a means prevents unwanted or accidental leakage, removal, or withdrawal of such a substance, which can be hazardous chemicals used in surgeries. In some embodiments, the means 300 may include a plunger 302 having a plunger tail 304 and a plunger head 306, a spring 304, and a spring retainer 310 having a spring retainer base 312 and spring retainer clips 314 (two shown). The plunger head 306 is in contact with the spring 308 which is in contact with the spring retainer base 312 of the spring retainer 310. The spring retainer clips 314 may be arranged within spring retainer clip openings 316 of the lower portion 206.

Figure 4:
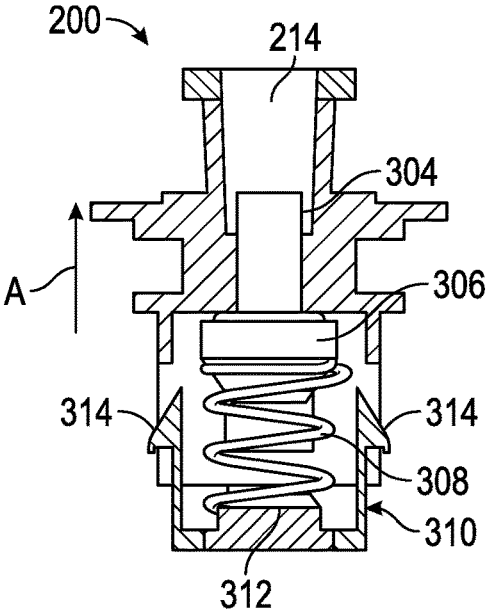
FIG. 4 illustrates a means for enabling the substance to be withdrawn from the vial only when a syringe is matingly engaged to the vial assembly, according to one or more embodiments.

Briefly turning to FIG. 4, illustrated is a means for enabling the substance to be withdrawn from the vial only when a syringe is matingly engaged to the vial assembly, according to one or more embodiments. In particular, FIG. 4 depicts the plunger tail 304 partially arranged within the channel 214, the plunger head 306 in contact with the spring 308, and the spring 308 in contact with the retainer base 312. The spring retainer clips 314 are arranged within the retainer clip openings 316, thereby confining the spring retainer 310 to limited movement. Resulting therefrom, the spring 308 creates forces in the direction A, thereby forcing the plunger tail 304 into the channel 214 and precludes substance from being removed from the vial 202, such as by dripping or spilling. However, upon sealing engagement by a syringe, the syringe may press on the plunger tail 304, accordingly forcing the plunger head 306 to act against the spring 308 and enable fluid to flow through the first inlet 210, past the plunger 302, and through the channel 214 into the syringe.

Referring now back to FIG. 3, in further embodiments, the assembly 200 may include a securing cap 316 for securing the assembly body 206, and in some embodiments, the means for enabling chemical withdrawal only when a syringe 220 is matingly engaged to the second portion 208, to the vial 202.

Figure 5:
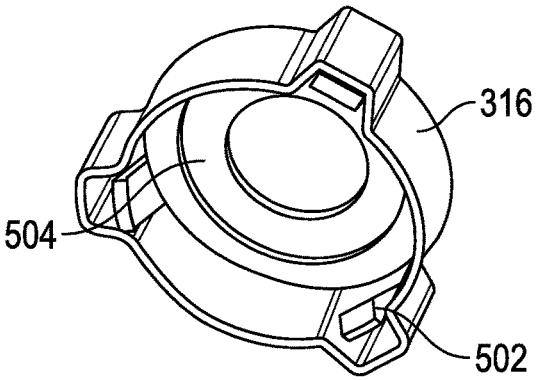
FIG. 5 illustrates a bottom-angled view of a securing cap, according to one or more embodiments.

Referring now to FIG. 5 is a bottom-angled view of the securing cap 316, according to one or more embodiments. In particular, the securing cap 316 includes a plurality of arms 502 (three shown) which operate to engage with the annular lip 218 of the vial 202, thereby securing the securing cap 316 to the vial 202 and preventing removal of the assembly 200. Those of skill in the art will appreciate that more or less than three arms 502 may be employed without departing from the scope of the invention. In some embodiments, the securing cap 316 may also include a recessed area 504 of a slightly larger diameter than the vial assembly shoulder 224, thereby enabling the shoulder 224 to contact the securing cap 316 within the recessed area 504, and still allowing a flush seal with the annular lip 218.

Referring again back to FIG. 3, in further embodiments, the vial assembly 200 may include an assembly cover 318 which covers at least the second portion 208 and the securing cap 316 of the vial assembly 200. Such an assembly cover 318 may be employed after the substance has been deposited within the vial 202, and is advantageous to reduce or prevent contamination of the second portion 208, including the outlet 212 and the channel 214 which the syringe 220 interacts with when withdrawing the substance from the vial 202.

Figure 6:
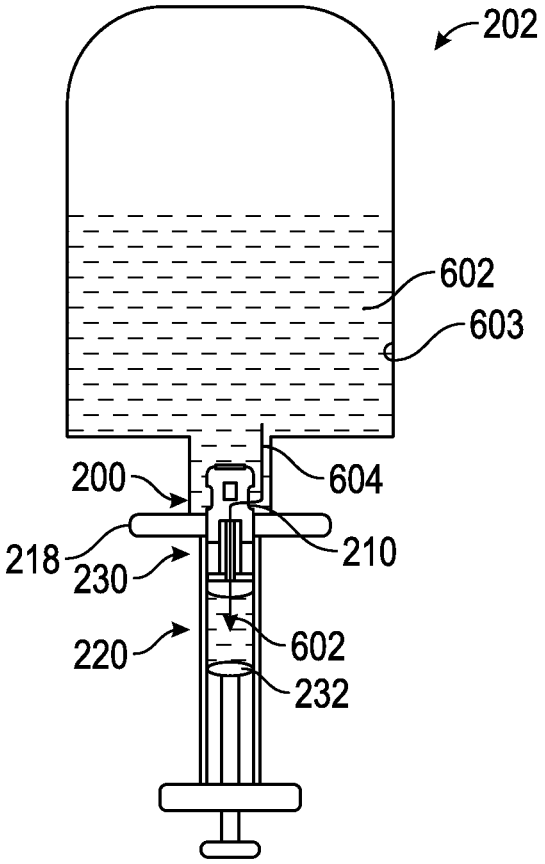
FIG. 6 illustrates a cross-sectional view of a syringe matingly engaged to the vial via the vial assembly, according to one or more embodiments.

FIG. 6 illustrates a cross-sectional view of a syringe 220 matingly engaged to the vial 202 via the vial assembly 200, according to one or more embodiments. A substance 602 is arranged on the interior 603 of the vial 202. As the plunger 232 of the syringe 220 is moved in a direction away from the vial 202, the substance 602 is drawn from the interior 603 of the vial 202 to the syringe 220 via the first inlet 210, the channel 214, the outlet 212 and the engagement mechanism 230. Advantageously, due to the first inlet 210 being proximate to the second portion 208 of the vial assembly 200, substantially all of the substance 602 within the vial 202 may be withdrawn therefrom.

Figure 7:
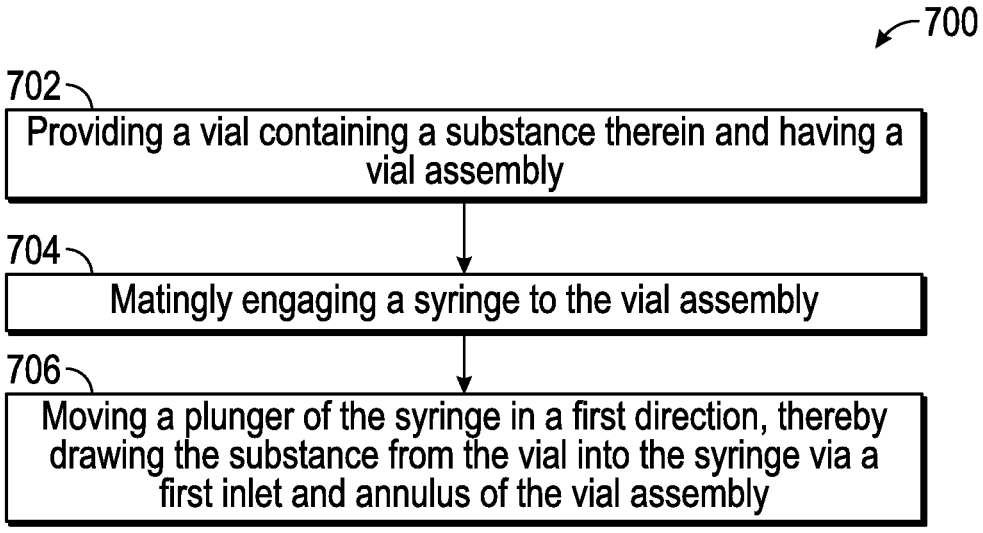
FIG. 7 is a flow diagram of an illustrative needle-less method for removing a substance from a vial via a needle-less assembly, according to one or more embodiments.

FIG. 7 is a flow diagram of an illustrative needle-less method for removing a substance from a vial via a needle-less assembly, according to one or more embodiments. At block 702, a vial containing a substance therein and having a vial assembly may be provided for use. The vial assembly may be arranged at least partially within the neck of the vial, and include a first portion arranged within the vial for receiving the substance, a second portion that includes a means for matingly engaging with a syringe, and a channel defined therein, thereby enabling fluid communication of a substance between the vial and the syringe. The vial assembly further includes a first inlet arranged longitudinally along a length of the first portion and proximate to the second portion, wherein the first inlet enables fluid communication between an interior of the vial and the channel, thereby enabling withdrawal of substantially all of the substance within the vial, and an outlet arranged at an end of the second portion of the body, thereby enabling a needle-less transfer of substances between the channel and the syringe.

At block 704, the syringe matingly engages to the vial assembly, thereby enabling withdrawal of the substance within the vial via the first inlet, the channel, and the outlet. In some embodiments, such means for matingly engaging comprise one of a luer-lock or luer-slip engagement between the second portion of the assembly body and the syringe. Further embodiments include where the second portion is a female luer which includes tabs, and the syringe includes a threaded male luer.

At block 706, the plunger may be moved in a first direction away from the vial, thereby drawing the substance from the vial into the syringe via the first inlet and the channel of the vial assembly. Some embodiments include a plurality of first inlets arranged circumferentially about the first portion, thereby enabling increased accuracy and speed of substance draw and removal from the vial. Alternatively, or in addition thereto, other embodiments may include a second inlet arranged at the end of the first portion, wherein the substance is at least partially drawn through the second inlet towards the syringe. Again, advantageously, such may enable increased accuracy and speed of substance draw and removal from the vial.

Even further embodiments include a means for sealingly engaging the assembly body to the neck of the vial. For example, such sealingly engaging means may include a plastic or rubber gasket arranged about the exterior of the first portion. Alternatively, other embodiments include a means for enabling the substance to be withdrawn from the vial only when a syringe is matingly engaged to the second portion of the body. For example, such means may include a plunger, spring, and spring retainer, wherein the plunger has a plunger tail which acts to substantially preclude flow through the channel when pressured by the spring. However, the plunger may be depressed from the channel with the syringe when matingly engaged with the vial assembly, thereby enabling withdrawal of substance from the vial to the syringe via the first, and possibly second inlets, the channel, and the outlet.

Other embodiments, may include where the assembly body is arranged at least partially within the neck of the vial by a manufacturer after substances have been deposited within the vial. Such is advantageous due to then being readily usable, and not requiring assembly by, for example, doctors or nurses who will be withdrawing the substance in preparation for administration to a patient. Further advantages may also include assisting in maintaining sterilization of the substance within the vial, and/or the body of the vial assembly, as removal of other caps or stoppers from the vial (which may enable de-sterilization of the substance due to interaction with the air) would not be required prior to arranging the vial assembly at least partially within the neck of the vial.

Although the disclosure has been described and illustrated with respect to exemplary objects thereof, it will be understood by those skilled in the art that various other changes, omissions, and additions may be made therein and thereto without departing from the scope of the present disclosure. Moreover, the figures described and depicted herein should not be interpreted as being to exact size or scale.

What is claimed is:

1. A needle-less substance transfer system adapter, comprising:

a substance transfer assembly configured to telescopically engage with a vial neck of a medicament vial;

a first portion of said substance transfer assembly having means for sealingly engaging with an interior wall of said vial neck, said means for sealingly engaging with said interior wall being entirely disposed within said vial neck, said first portion having a first inlet configured to receive a substance from said vial;

a second portion of said substance transfer assembly having means for matingly engaging with a syringe and an outlet configured to dispense said substance to said syringe;

a channel defined through said first portion and said second portion, thereby enabling fluid communication of said substance from said vial to said syringe via said first inlet and said outlet, said channel extending into said medicament vial beyond said means for sealingly engaging with said interior wall; and reversibly actuable valve means positioned in said channel for, when not actuated, occluding flow of contents of said vial through said channel, and, upon actuation, at least partially unoccluding said flow.

2. The needle-less substance transfer system adapter of claim 1, wherein said valve means is configured for actuation through insertion of a distal portion of said syringe into said channel whereby force is applied by said distal portion against said valve means.

3. The needle-less substance transfer system of claim 2, further comprising a plurality of first inlets arranged circumferentially about said first portion of said substance transfer assembly, thereby enabling increased accuracy and speed of substance draw and removal from said vial.

4. The needle-less substance transfer system of claim 1, wherein said first inlet is arranged longitudinally along a length of said first portion, thereby enabling an increased removal rate of said fluid from said vial.

5. The needle-less substance transfer system of claim 1, further comprising a second inlet arranged at the end of said first portion of said substance transfer assembly, thereby enabling increased accuracy and speed of substance draw and removal from said vial.

6. The needle-less substance transfer system of claim 1, further comprising prevention means for substantially precluding substance from being withdrawn from said vial unless said syringe is matingly engaged to said second portion of said substance transfer assembly.

7. The needle-less substance transfer system of claim 6, wherein said prevention means comprises a plunger, spring, and spring retainer.

8. The needle-less substance transfer system of claim 1, further comprising cover means for covering said second portion, thereby precluding mating of said syringe with said second portion.

9. The needle-less substance transfer system of claim 1, wherein said substance transfer assembly further comprises a shoulder configured to be arranged adjacent to an annular lip of said vial neck.

10. A method for removing a substance from a vial, comprising:

sealingly engaging a surface of a substance transfer assembly adapter with an interior wall of a vial neck of a medicament vial, said surface being disposed entirely within said vial neck, wherein said substance transfer assembly adapter comprises:

a first portion having a first inlet configured to receive a substance from said vial;

a second portion having means for matingly engaging with a syringe and an outlet configured to dispense said substance to said syringe; and a channel defined through said first portion and said second portion, thereby enabling fluid communication of said substance from said vial to said syringe via said first inlet and said outlet, said channel extending into said medicament vial beyond said surface; and reversibly actuable valve means positioned in said channel for, when not actuated, occluding flow of contents of said vial through said channel, and, upon actuation, at least partially unoccluding said flow;

matingly engaging said syringe to said second portion of said substance transfer assembly to apply said force to said valve means; and removing said substance from said vial to said syringe via movement of a plunger of said syringe in a first direction, thereby drawing said substance from said vial into said syringe via said first inlet and said outlet.

11. The method of claim 10, wherein said valve means is configured for actuation through insertion of a distal portion of a said syringe into said channel whereby force is applied by said distal portion against staid valve means.

12. The method of claim 11, wherein said substance transfer assembly further comprises a plurality of first inlets arranged circumferentially about said first portion of said substance transfer assembly, thereby enabling increased accuracy and speed of substance draw and removal from said vial.

13. The method of claim 10, wherein said first inlet is arranged longitudinally along a length of said first portion, thereby enabling an increased removal rate of said fluid from said vial.

14. The method of claim 10, wherein said substance transfer assembly further comprises a second inlet arranged at the end of said first portion of said substance transfer assembly, thereby enabling increased accuracy and speed of substance draw and removal from said vial.

15. The method of claim 10, wherein said substance transfer assembly further comprises prevention means for substantially precluding substance from being withdrawn from said vial unless said syringe is matingly engaged to said second portion of said substance transfer assembly.

16. The method of claim 15, wherein said prevention means comprises a plunger, spring, and spring retainer.

17. The method of claim 10, wherein said substance transfer assembly further comprises cover means for covering said second portion, thereby precluding mating of said syringe with said second portion.

18. The method of claim 10, wherein said substance transfer assembly further comprises a shoulder configured to be arranged adjacent to an annular lip of said vial neck.

* * * * *